US006044773A

United States Patent [19]

Bauer

[11] Patent Number: 6,044,773

[45] Date of Patent: Apr. 4, 2000

[54] WORK STATION FOR HOLDING OBJECTS

[76] Inventor: Jörg R. Bauer, Gablerstr. 4, D-88250 Weingarten, Germany

[21] Appl. No.: 09/169,673

[22] Filed: Oct. 9, 1998

[30] Foreign Application Priority Data

Oct. 9, 1997 [DE] Germany ..... 197 44 624

[51] Int. Cl.[7] ..... A47B 35/00

[52] U.S. Cl. ..... 108/50.11; 108/55.3

[58] Field of Search ..... 108/28, 25, 26, 108/50.01, 50.02, 55.3, 61, 153.1, 180, 143; 312/209, 223.3

[56] References Cited

U.S. PATENT DOCUMENTS

| | | | |
|---|---|---|---|
| 1,766,230 | 6/1930 | Sea . | |
| 4,566,325 | 1/1986 | Rante | 108/143 X |
| 4,729,536 | 3/1988 | Scala | 108/143 X |
| 5,218,912 | 6/1993 | Buske | 108/26 |
| 5,290,058 | 3/1994 | Adams et al. | 108/143 X |
| 5,309,847 | 5/1994 | Matsumoto | 108/143 |
| 5,464,105 | 11/1995 | Mandeltort | 108/61 X |
| 5,483,902 | 1/1996 | Grosch | 108/143 |
| 5,497,708 | 3/1996 | Jeruzal | 108/55.3 X |
| 5,860,370 | 1/1999 | Poniecki | 108/153.1 X |

FOREIGN PATENT DOCUMENTS

| | | | |
|---|---|---|---|
| 30 44 290 | 6/1902 | Germany . | |
| 2253744 | 5/1973 | Germany | 108/187 |
| 34 29 188 | 2/1986 | Germany . | |
| 86 30 330 | 2/1987 | Germany . | |
| 39 19 078 | 2/1989 | Germany . | |
| 29 05 689 | 2/1991 | Germany . | |
| 295 17 690 | 3/1996 | Germany . | |
| 44 31 040 | 3/1996 | Germany . | |
| 686 033 | 12/1995 | Switzerland . | |
| 2 012 201 | 7/1979 | United Kingdom . | |

*Primary Examiner*—Jose V. Chen
*Attorney, Agent, or Firm*—Robert W. Becker & Associates

[57] ABSTRACT

A work station for holding objects is provided. The work station includes a frame and a slide block that is displaceably guided in the frame. Holding pins are insertable into upwardly open holes that are provided in the block and in the frame.

9 Claims, 5 Drawing Sheets

WORK STATION FOR HOLDING OBJECTS

BACKGROUND OF THE INVENTION

The present invention relates to a work station for holding objects.

There is a great need, both in industry as well as in the private sector, for work stations with which objects can be held in order to be able to work on them.

It is therefore an object of the present invention to provide a work station that is economical to produce and has a very flexible range of use.

BRIEF DESCRIPTION OF THE DRAWINGS

This object, and other objects and advantages of the present invention, will appear more clearly from the following specification in conjunction with the accompanying schematic drawings, in which.

SUMMARY OF THE INVENTION

Figure 1:
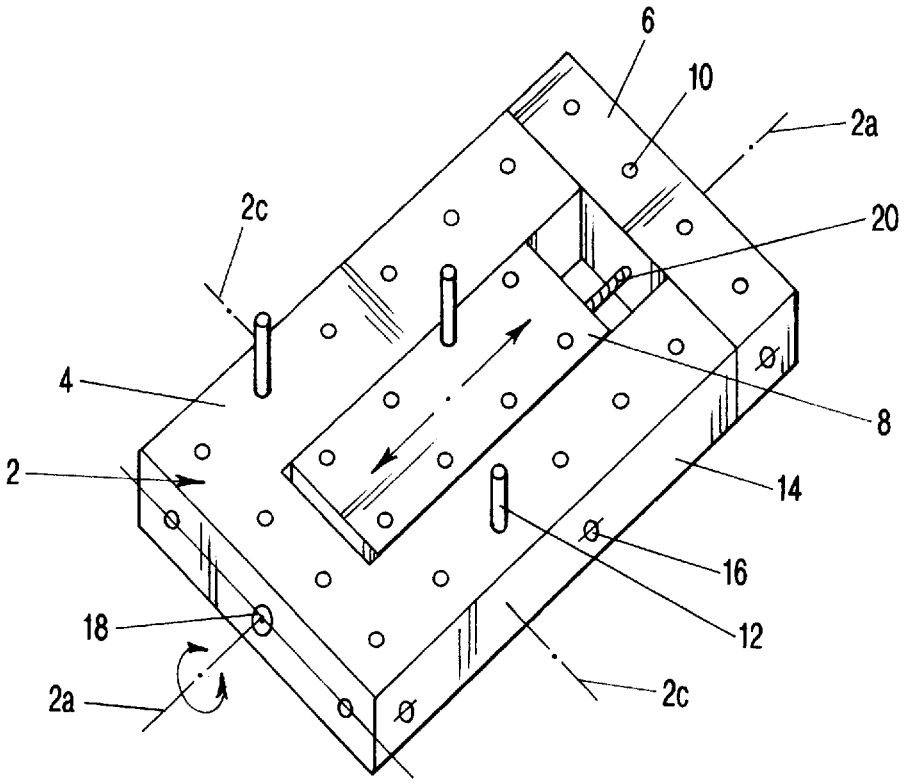
FIG. 1 is an isometric view of a first exemplary embodiment of the inventive work station.

The work station of the present invention comprises a frame, a slide block that is displaceably guided in the frame, wherein the block and the frame are provided with upwardly open holes, means for displacing the block in the frame, and holding pins insertable in the holes.

With the inventive work station, the object that is to be held can not only be held between an end face of the block and an end face of an opening of the frame in which the block is guided, which end face faces the block, but the object can also be held by holding pins that can be inserted from above into holes provided in the block and in the frame. The block and the frame thus preferably form a planar upper surface upon which the object that is to be held is placed and then held by the holding pins by moving the block relative to the frame. The inventive work station is compact and can be mounted at many different locations.

Further specific features of the present invention will be described in detail subsequently.

DESCRIPTION PREFERRED OF THE EMBODIMENTS

Referring now to the drawings in detail, the work station has an overall rectangular frame 2 that comprises a U-shaped frame part 4 and a segment 6 that is fastened to the frame part 4. A carriage or slide block 8 is movable back and forth in the direction of the double arrow in an opening formed within the frame 2. The block 8 and the frame 2 form a planar upper surface in which are formed holes 10 for the insertion of holding pins 12. At least some of the holes 10 extend all the way through the frame 2.

Threaded holes 16 are provided in the outer peripheral surface 14 of the frame 2. In a through bore 18 formed in one peripheral end face of the frame 2 the end of a threaded rod 20 is accessible, for example in the form of a square end, so that a crank can be placed upon the threaded rod 20. Similarly, by means of a through bore that is not visible in FIG. 1, the threaded rod 20 is accessible from the outer side of the segment 6.

Figure 2A:
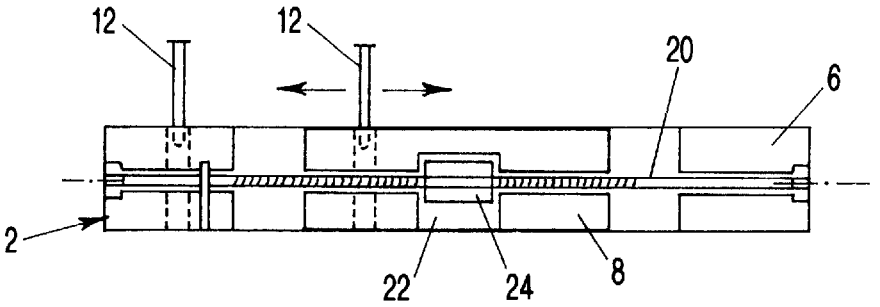
FIGS. 2*a*–2*c* show various cross-sectional views of the work station of FIG. 1.
Figure 2B:
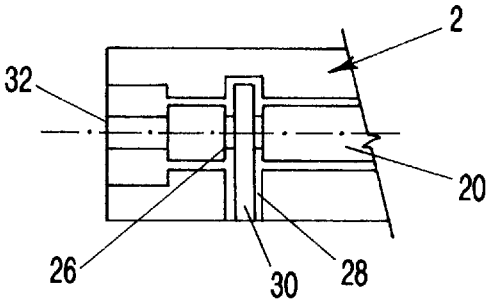

FIG. 2*a* shows a vertical cross-section through the frame 2 of FIG. 1 along the line 2*a*–2*a* thereof. The block 8 has a recess 22 in which is disposed a threaded bushing 24, the threads of which engage the threaded rod 20. The threaded bushing 24 is accommodated in the longitudinal direction of the threaded rod 20 while fitting in the recess 22. So that the threaded rod 20 is rotatable in the holding frame 2, yet is not longitudinally displaceable, it is provided, as can be seen from the enlarged end view of the threaded rod 20 and pertaining region of the frame 2 in FIG. 2*b*, with an annular groove 26 into which is snapped a spring element 30 that is disposed in a slot-like recess 28 of the frame 2. The spring or retainer element 30 has, for example, an overall U-shaped configuration, the elastically spreadable legs of which snap into the annular groove 26. In this way the threaded rod 20, only the central portion of which needs to be provided with a thread, cannot move in a longitudinal direction, yet is rotatably accommodated in the holding frame 2. As can further be seen, the end of the threaded rod 20 can, for example, be embodied as a square end 32 that is accessible from the outside of the frame 2 in order to be able to turn the threaded rod 20 with a tool.

Figure 2C:
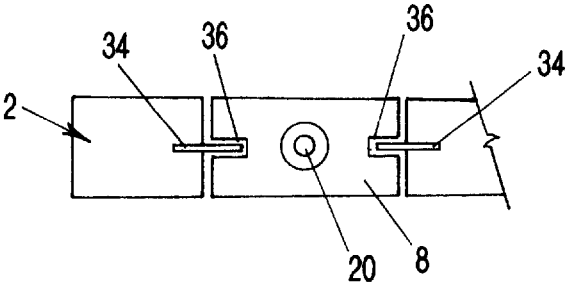

FIG. 2*c* illustrates a cross-section through the work station along the line 2*c*–2*c* in FIG. 1. Disposed in the side surfaces of the frame 2 that are adjacent to the block 8 are flat or plate-like pieces 34 that act as guide means and are made, for example, of metal; the flat pieces 34 extend into corresponding grooves 36 of the block 8. The assembly of the work station will now be explained.

With the segment 6 removed, the flat pieces 34 and the threaded rod 20 are inserted into the open U-shaped frame part 4. The threaded rod 20 is secured in place by inserting the spring element 30. Subsequently, the block 8 is inserted, whereby the threaded rod 20 engages the threaded bushing 24 and is rotated until the block 8 is moved sufficiently far into the frame part 4. The segment 6 is then secured to the frame part 4, for example by being screwed thereto, by being adhesively fastened, etc., whereby the threaded rod 20 extends through a throughbore provided in the segment 6.

The thus-assembled work station provides an extremely flexibly usable tool on which very different types of components can be reliably held by inserting the holding pins 12 into the frame 2 and the block 8. By inserting screws from above through the holes 10, the frame 2 can be secured on any surface, or can be secured to side walls by means of the threaded holes 16 provided on the sides of the frame 2. The frame 2 can also be temporarily secured to some other component by screw clamps or the like.

The frame 2 and the block 8 can be made of all kinds of materials, such as wood, plywood or pressboard, plastic, metal, etc.

Figure 3:
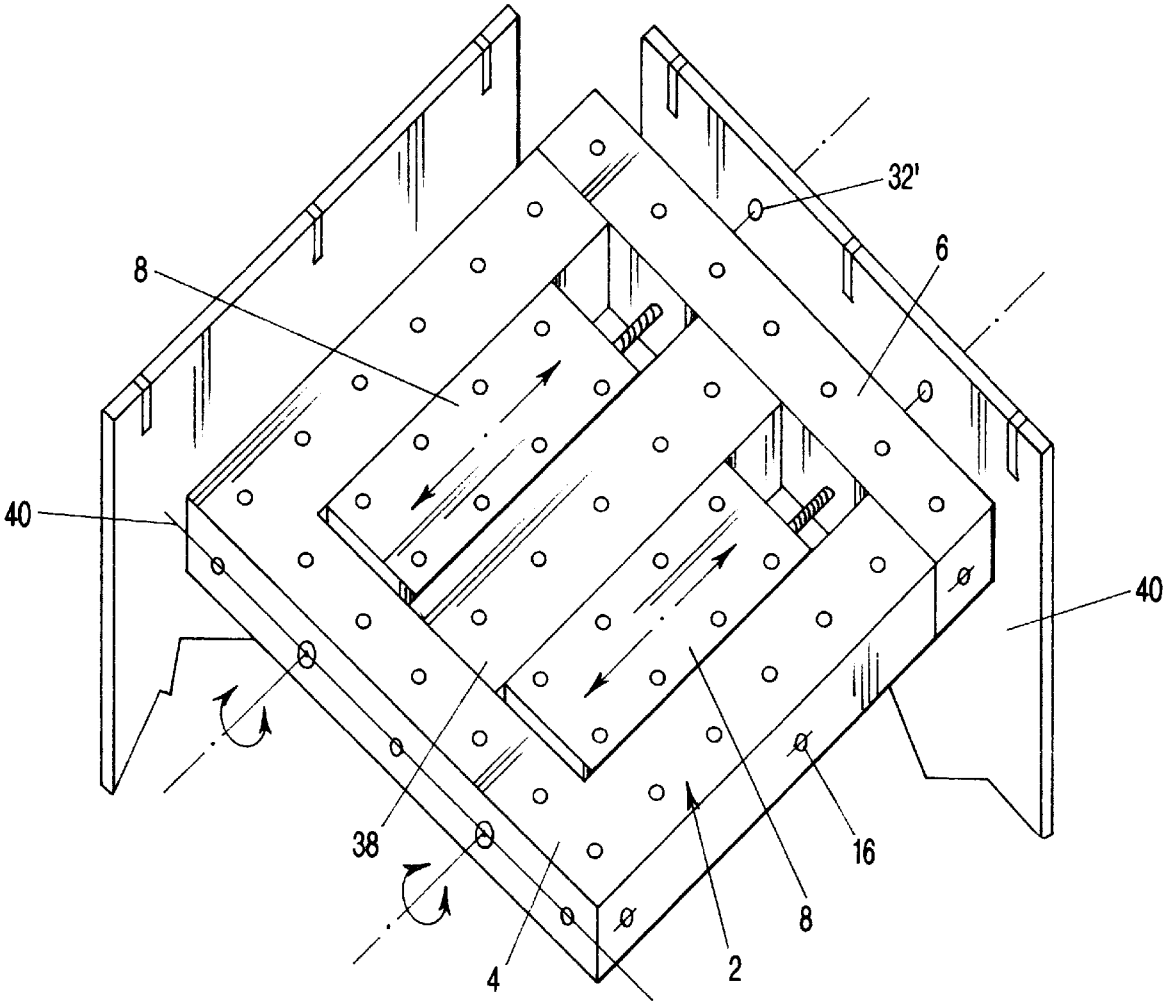
FIGS. 3 is an isometric view of a further exemplary embodiment of an inventive work station.

FIG. 3 shows an embodiment of the inventive work station where two blocks 8 are provided that are longitudinally movable in the frame 2. The frame 2 again has a U-shaped frame part 4 and the segment 6. In addition, the separator 38 is provided that is either integrally formed with the frame part 4, or can be somehow connected thereto, such as being screwed thereto or adhesively secured thereto. It is to be understood that the blocks 8 are longitudinally guided along the frame part 4 and the separator 38.

Also indicated in FIG. 3 are wall sections 40 to which the peripheral surfaces of the frame 2 can be screwed or otherwise secured so that the work station forms the upper cover plate of a stand or support. It is to be understood that the wall sections 40 are provided with holes for inserting screws (not illustrated) that engage the threaded holes 16 of the frame 2, as well as with further holes 32' through which the ends of the threaded rod 20 are accessible.

It is furthermore to be understood that the two blocks 8 need not necessarily be disposed so as to be movable parallel to one another. In addition, a work station could be provided with more than two blocks.

Figure 4B:
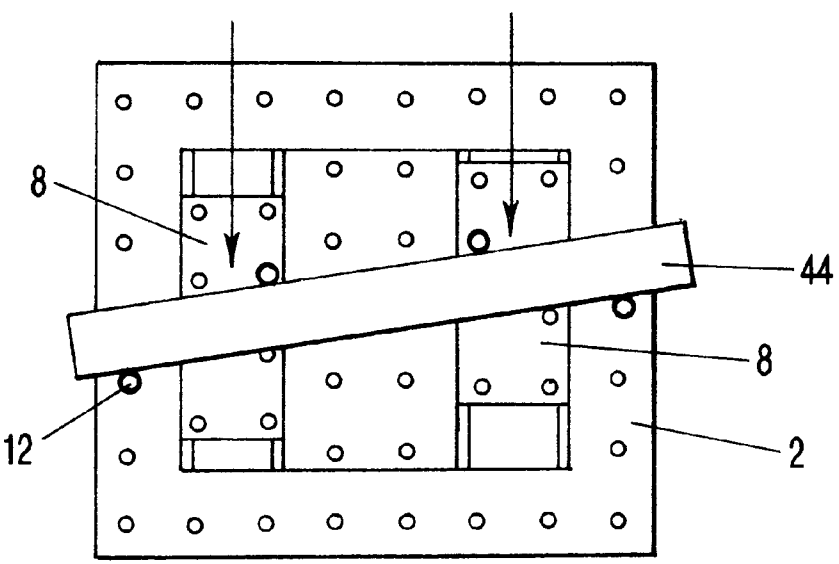
FIGS. 4*a* and 4*b* are views of the work station of FIG. 3 with objects being held.
Figure 4A:
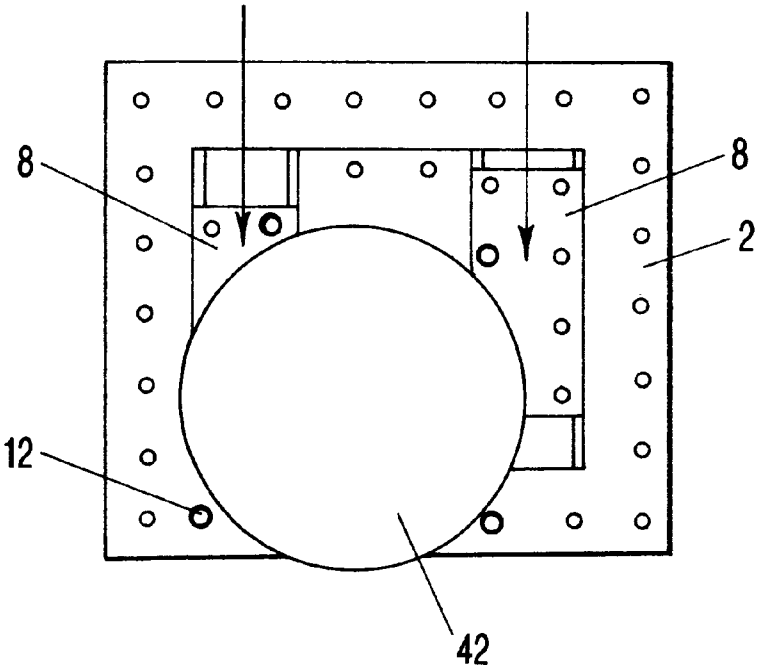

FIGS. 4*a* and 4*b* show how various objects can be held in the work station of FIG. 3. For example, in FIG. 4*a* a round object 42 is held between the holding pins 12, two of which are securely held on the frame 2 while further pins are respectively disposed on the blocks 8. A bar-shaped object 44 is shown being held in FIG. 4*b*.

FIG. 5 shows various arrangements of work stations 50, each of which has the configuration shown in FIG. 3.

Figures 5A, 5B, 5C:
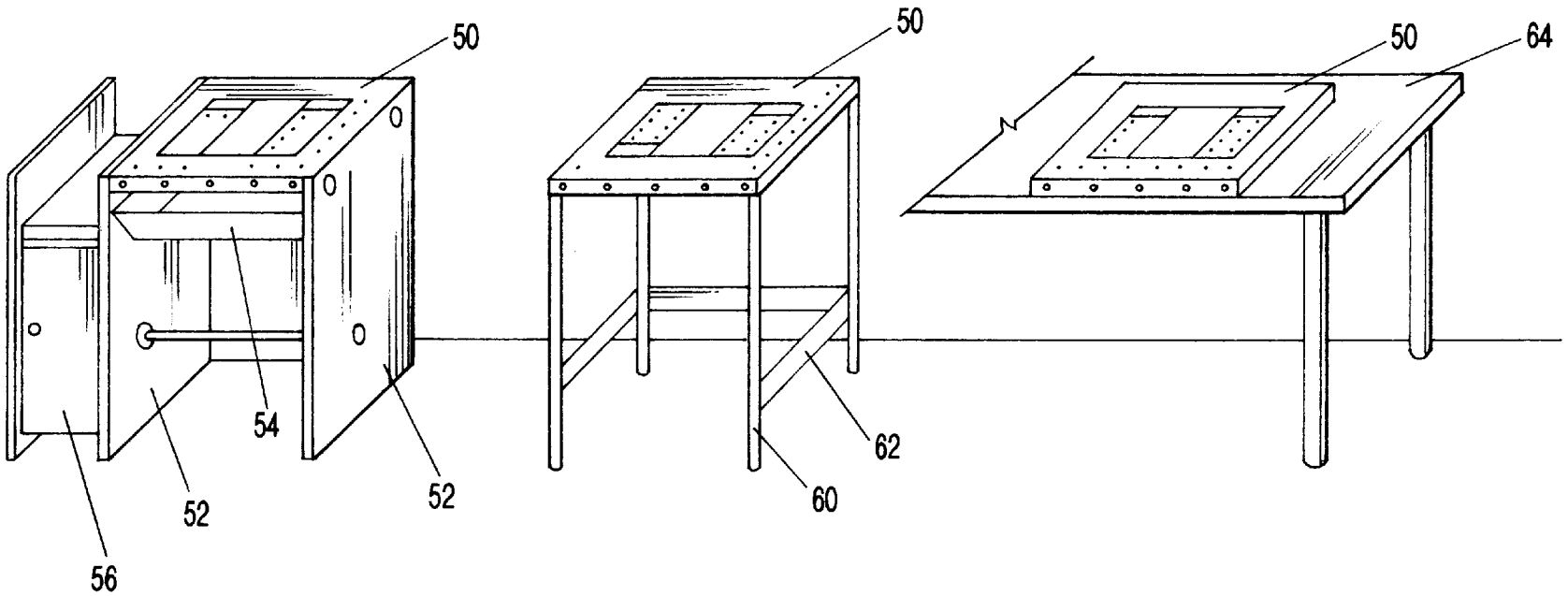
FIGS. 5*a*–5*c* show various mounting arrangements for the work station.

In FIG. 5*a*, the work station 50 forms the cover plate of a support having two side walls 52 that are secured to opposite peripheral surfaces of the work station 50. Provided below the work station 50 is a catch pan 54 for collecting dirt that results during the processing or mechanical treatment of a workpiece held by the work station 50. A cabinet 56 is built onto the side of the left side wall 52.

It is to be understood that the frame of the work station 50, with its separators, can be secured to the side walls 52 in such a way that the catch pan for the most part collects all dirt that results.

In FIG. 5*b*, the work station 50 is secured to four legs 60, which are additionally stabilized by means of braces 62.

In the arrangement shown in FIG. 5*c*, the work station 50 is secured from above to a tabletop 64.

Figure 6:
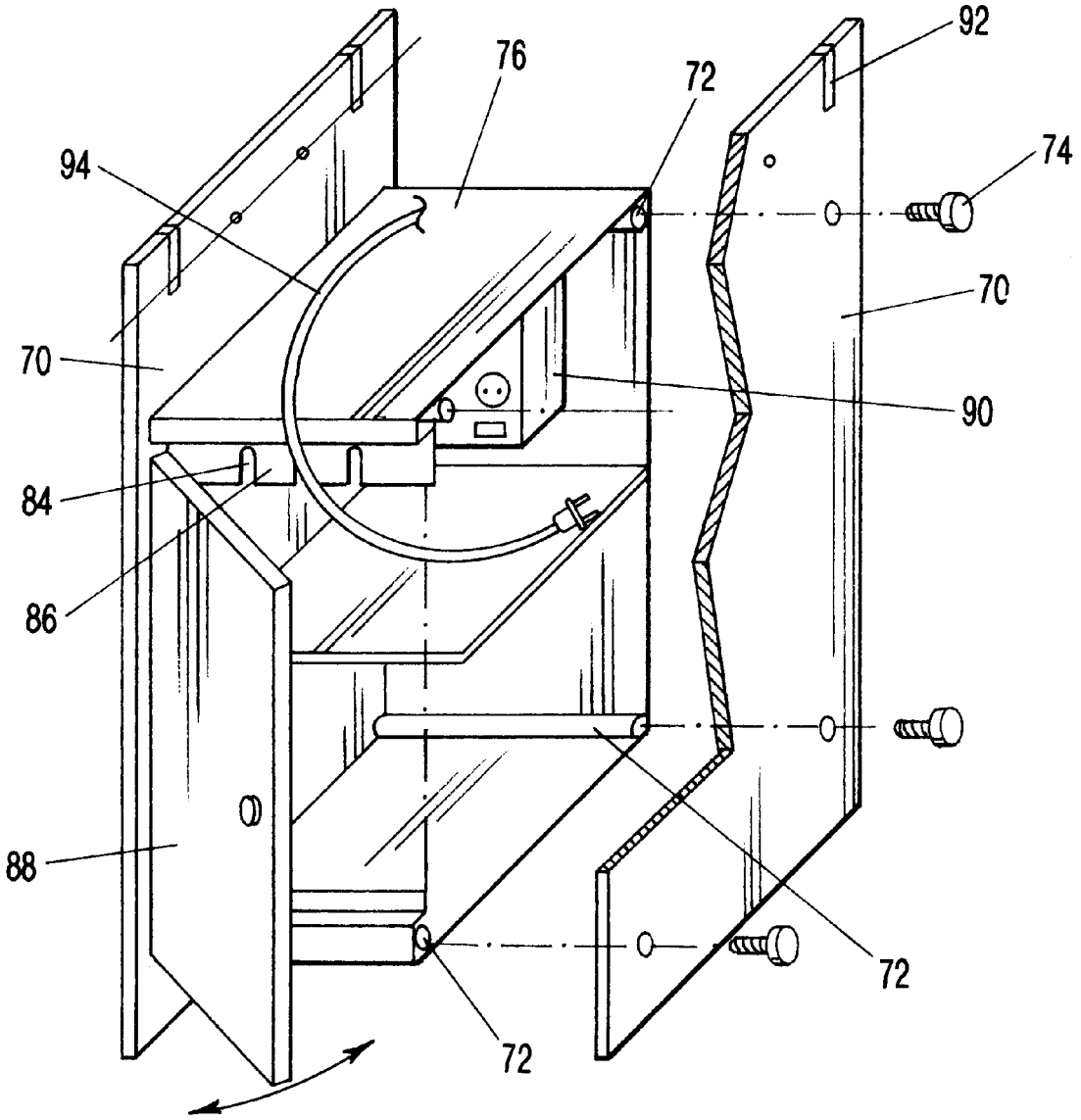
FIG. 6 is a partially exploded isometric view of a stand or support that can be provided for the work station.

FIG. 6 shows a stand or support that can be advantageously used for a work station, which is not illustrated. The stand comprises two wall sections 70 that can be secured to one another by means of spacers 72 and screws 74 that can be screwed into the spacers through the wall sections 70. The spacers 72 are disposed in the corners of a case or box 76, which is embodied, for example, as profiled sheet metal, and whose front, upper rim is bent to form a slotted member 86 that is provided with slots 84. A door 88 rests against the slotted member 86 when closed in such a way that the upper ends of the slots 84 remain exposed. In this way, an electrical cord 94 that is guided through one of the slots 84 and is designed for a non-illustrated electrical device is accommodated in the slot 84 when the door is closed and locked such that it is secure from theft, so that at the same time the electrical device is protected from theft. Located in the box 76 is an electric terminal 90, which is in this way protected against unauthorized access.

The work station, which is not illustrated in FIG. 6, can be secured to the wall sections 70 via the threaded holes 16 (see FIGS. 1 or 3) provided in its peripheral surfaces. This is made possible in a particularly simple manner if the work station, with screws 74 loosely screwed therein, is placed from above into the slots 92 provided in the wall sections 70.

The specification incorporates by reference the disclosure of German priority document 197 44 624.8 of Oct. 9, 1997.

The present invention is, of course, in no way restricted to the specific disclosure of the specification and drawings, but also encompasses any modifications within the scope of the appended claims.

What I claim is:

1. A work station for holding objects, comprising:

a peripheral frame having an inner opening that is provided with two parallel guide means that face one another;

a slide block that is displaceably guided on said guide means, wherein an upper surface of said slide block and of said frame form a planar surface that is provided with holes, and wherein ones of said holes provided in said frame surround said slide block;

means for displacing said slide block relative to said frame, wherein said means is actuatable externally of said frame; and holding pins insertable into said holes of said slide block and of said frame for engaging and holding an object.

2. A work station according to claim 1, wherein at least some of said holes extend all the way through said frame.

3. A work station according to claim 1, wherein threaded holes are provided on an outer periphery of said frame.

4. A work station according to claim 1, wherein said guide means are formed by flat pieces disposed in inner sides of said frame, and wherein said block is provided with lateral grooves for engaging said flat pieces.

5. A work station according to claim 1, wherein said means for displacing said block relative to said frame is in the form of a threaded rod that extends through said frame and said block and that is mounted in said frame so as to be rotatable therein but not longitudinally displaceable relative thereto, wherein a threaded bushing is provided in said block and is in engagement with said threaded rod, and wherein said threaded rod is rotatable from outside said frame.

6. A work station according to claim 1, wherein said frame has a quadrilateral configuration and includes a U-shaped part to form said inner opening, and wherein said frame further includes a segment for closing off said opening, which is provided in said frame for receiving said block.

7. A work station according to claim 1, wherein said frame is provided with a separator to form two rectangular openings, in each of which is disposed a respective one of said blocks, each of which is provided with a respective means for displacing, so that two adjacent blocks, separated by said separator, are displaceable independently of and parallel to one another.

8. A work station according to claim 1 wherein said work station forms a cover plate of a support that includes a case having a door for closing same and accommodating an electric terminal, wherein said door in a closed state partially covers an open end of a slot formed in a slotted member of said case in such a way that an electrical cord that extends outwardly through said slot out of the interior of said case is held in such a way as to be secure against theft.

9. A work station according to claim 1, wherein said work station forms a cover plate of a support, and wherein a catch pan is provided below said work station.

* * * * *